US009062891B2

(12) United States Patent
Li et al.

(10) Patent No.: US 9,062,891 B2
(45) Date of Patent: Jun. 23, 2015

(54) ENERGY SAVING CONTROLLING METHOD AND DEVICE OF INVERTER AIR-CONDITIONER

(71) Applicant: GUANGDONG MIDEA REFRIGERATION APPLIANCES CO., LTD., Foshan, Guangdong (CN)

(72) Inventors: Qiang Li, Foshan (CN); Zhiguo Zhang, Foshan (CN); Jinbo Li, Foshan (CN); Qiangbing Zeng, Foshan (CN); Xinyun Pan, Foshan (CN); Shuisheng Zheng, Foshan (CN); Wenduan Qi, Foshan (CN); Shoumin Chan, Foshan (CN); Lei Wang, Foshan (CN); Haisheng Lu, Foshan (CN); Lianghong Zhu, Foshan (CN); Canbin Huang, Foshan (CN); Ling Luo, Foshan (CN)

(73) Assignee: GUANGDONG MIDEA REFRIGERATION APPLIANCES CO., LTD., Foshan (CN)

( * ) Notice: Subject to any disclaimer, the term of this patent is extended or adjusted under 35 U.S.C. 154(b) by 0 days.

(21) Appl. No.: 13/787,851

(22) Filed: Mar. 7, 2013

(65) Prior Publication Data

US 2014/0012423 A1 Jan. 9, 2014

(30) Foreign Application Priority Data

Jul. 9, 2012 (CN) ..... 2012 1 0236422
Dec. 3, 2012 (WO) ..... PCT/CN2012/085764

(51) Int. Cl.
*G05D 23/00* (2006.01)
*F24F 11/00* (2006.01)

(52) U.S. Cl.
CPC ..... *F24F 11/006* (2013.01); *F24F 2011/0075* (2013.01)

(58) Field of Classification Search
None
See application file for complete search history.

(56) References Cited

U.S. PATENT DOCUMENTS 5,219,119 A * 6/1993 Kasper et al. ..... 236/46 R
5,675,503 A * 10/1997 Moe et al. ..... 700/296

(Continued)

FOREIGN PATENT DOCUMENTS

CN 101833310 A 9/2010
JP WO 2012/056533 * 5/2012 ..... F24F 11/02

OTHER PUBLICATIONS

United Nations, World Economic and Social Survey 2011,United Nations Publication.*

(Continued)

*Primary Examiner* — Sean Shechtman

(57) ABSTRACT

The present disclosure provides an energy saving controlling method of an inverter air-conditioner, including: a main controlling unit of the inverter air-conditioner receiving settings of an energy consumption and an operating time; according to the set energy consumption and the set operating time, calculating or retrieving operational parameters of the inverter air-conditioner based on that the inverter air-conditioner consumes the set energy consumption in the set operating time; and controlling the inverter air-conditioner to operate according to the calculated or retrieved operational parameters. By receiving the settings of the energy consumption and the operating time from user which can be combined with the target indoor temperature, and calculating or retrieving the corresponding operational parameters of the inverter air-conditioner, the inverter air-conditioner can operate according to the operational parameters, which allows the user to control the energy consumption and the using cost of the inverter air-conditioner directly and accurately.

10 Claims, 2 Drawing Sheets

(56) References Cited

U.S. PATENT DOCUMENTS

| | | | | |
|---|---|---|---|---|
| 6,644,054 | B1 * | 11/2003 | Kettner et al. | 62/228.3 |
| 7,181,293 | B2 * | 2/2007 | Rothman et al. | 700/22 |
| 7,840,825 | B2 * | 11/2010 | Altevogt et al. | 713/320 |
| 2002/0042683 | A1 * | 4/2002 | Shincovich | 702/61 |
| 2004/0020222 | A1 * | 2/2004 | Miwa | 62/186 |
| 2005/0212501 | A1 * | 9/2005 | Acatrinei | 323/283 |
| 2007/0043477 | A1 * | 2/2007 | Ehlers et al. | 700/276 |
| 2008/0046388 | A1 * | 2/2008 | Budike, Jr. | 705/412 |
| 2009/0045804 | A1 * | 2/2009 | Durling et al. | 324/140 R |
| 2011/0077789 | A1 * | 3/2011 | Sun | 700/291 |
| 2011/0106316 | A1 * | 5/2011 | Drew et al. | 700/278 |
| 2013/0178988 | A1 * | 7/2013 | Miwa | 700/276 |
| 2013/0216398 | A1 * | 8/2013 | Stephens | 417/3 |

OTHER PUBLICATIONS

International Search Report of PCT Application No. PCT/CN2012/085764.

* cited by examiner

ENERGY SAVING CONTROLLING METHOD AND DEVICE OF INVERTER AIR-CONDITIONER

CROSS-REFERENCE TO RELATED APPLICATIONS

This present application claims the benefits of PCT application No. PCT/CN2012/085764 filed on Dec. 3, 2012 and Chinese Patent Application No. 201210236422.X filed on Jul. 9, 2012; the contents of which are hereby incorporated by reference.

BACKGROUND

1. Technical Field

The present invention relates to energy saving controlling technologies of inverter air-conditioners, and particularly, to an energy saving controlling method and device of an inverter air-conditioner.

2. Description of Related Art

Nowadays, controlling of an inverter air-conditioner (air conditioning device with controllable rotating speed) is generally realized by setting a target indoor temperature. When energy saving is required, the energy saving can be realized by increasing the target indoor temperature if the air-conditioner works in the refrigeration mode and by decreasing the target indoor temperature if the air-conditioner works in the heating mode. In the above controlling method, the energy consumption in unit time is unclear to user(s) and the energy consumption cannot be relatively accurately controlled, which prevents the user from controlling the using cost of the inverter air-conditioner accurately.

SUMMARY

The main object of the present disclosure is to provide an energy saving controlling method of an inverter air-conditioner, which allows the user to accurately control the energy consumption and using cost of the inverter air-conditioner.

The energy saving controlling method of an inverter air-conditioner includes:

a main controlling unit of the inverter air-conditioner receiving settings of an energy consumption and an operating time;

according to the set energy consumption and the set operating time, calculating or retrieving operational parameters of the inverter air-conditioner based on that the inverter air-conditioner consumes the set energy consumption in the set operating time; and controlling the inverter air-conditioner to operate according to the calculated or retrieved operational parameters.

Preferably, the operational parameters of the inverter air-conditioner correspond to a constant power of the inverter air-conditioner, the energy consumption is X, the operating time is T, and an operating power of the inverter air-conditioner is X/T.

Preferably, the operational parameters of the inverter air-conditioner correspond to a variable power of the inverter air-conditioner, the energy consumption is X, the operating time is T, the set operating time T is divided into time periods from T1 to Tn, the set energy consumption X is correspondingly divided into sections from X1 to Xn, wherein n is a natural number greater than or equal to 2, the operating power of the inverter air-conditioner in each phase is obtained by dividing the energy consumption of the corresponding phase by the operating time of the corresponding phase, and X1/T1>Xn/Tn.

Preferably, X ranges from 1 KW*h to 3 KW*h, and T ranges from 5 h to 10 h.

Preferably, the settings further include the setting the target indoor temperature.

Preferably, the energy consumption and the operating time, or the energy consumption and the operating time and the target indoor temperature are preset by system; or, options corresponding to the energy consumption and the operating time, or options corresponding to the energy consumption and the operating time and the target indoor temperature are preset to be chosen by a user.

The present disclosure further provides an energy saving controlling device of an inverter air-conditioner, including:

a setting receiving module for receiving settings of an energy consumption and an operating time through a main controlling unit of the inverter air-conditioner;

a parameter calculating or retrieving module for calculating or retrieving operational parameters of the inverter air-conditioner based on that the inverter air-conditioner consumes the set energy consumption in the set operating time according to the set energy consumption and the set operating time; and a parameter executing module for controlling the inverter air-conditioner to operate according to the calculated or retrieved operational parameters.

Preferably, the operational parameters of the inverter air-conditioner correspond to a constant power of the inverter air-conditioner, the energy consumption is X, the operating time is T, and an operating power of the inverter air-conditioner is X/T.

Preferably, the operational parameters of the inverter air-conditioner correspond to the a variable power of the inverter air-conditioner, the energy consumption is X, the operating time is T, the set operating time T is divided into time periods from T1 to Tn, the set energy consumption X is correspondingly divided into sections from X1 to Xn, wherein n is a natural number greater than or equal to 2, the operating power of the inverter air-conditioner in each phase is obtained by dividing the energy consumption of the corresponding phase by the operating time of the corresponding phase, and X1/T1>Xn/Tn.

Preferably, X ranges from 1 KW*h to 3 KW*h, and T ranges from 5 h to 10 h.

Preferably, the settings further include the setting of a target indoor temperature.

Preferably, the energy consumption and the operating time, or the energy consumption and the operating time and the target indoor temperature are preset by system; or, options corresponding to the energy consumption and the operating time, or options corresponding to the energy consumption and the operating time and the target indoor temperature are preset to be chosen by user.

By receiving the settings of the energy consumption and the operating time from user which can be combined with the target indoor temperature, and calculating or retrieving the corresponding operational parameters of the inverter air-conditioner, the inverter air-conditioner can operate according to the operational parameters, which allows the user to control the energy consumption and the using cost of the inverter air-conditioner directly and accurately.

DESCRIPTION OF THE DRAWINGS

Many aspects of the embodiments can be better understood with reference to the following drawings. The components in the drawings are not necessarily dawns to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment is this disclosure are not necessarily to the same embodiment, and such references mean at least one.

A power factor correction (FPC) module of an outdoor unit of an inverter air-conditioner is generally provided with functions of current detection and voltage detection, and a power of an indoor unit of the inverter air-conditioner can be calculated by mature fuzzy calculating method, which can realize the detection of the power of the whole air-conditioner. Or, the detection of the power of the whole air-conditioner can be realized via extra detecting device(s) used for detecting the current or voltage of the whole air-conditioner. The calculation or retrieval of operational parameters of a target power of the whole air-conditioner can be realized by setting the target operating power in predetermined chosen working conditions and detecting the actual operating power; and the target operating power and the actual operating power are compared thereafter to increase or decrease an operating frequency of a compressor and/or the operating frequency of a fan, which allows the operating power of the inverter air-conditioner to be close to the target operating power. The experimental operational parameters of the air-conditioner then are retrieved to be the operational parameters under the same target power, thus, the operational parameters of the air-conditioner can be controlled by the target power. It is noted that the operational parameters of the air-conditioner under the target power can also be calculated according to the fuzzy calculating methods, which can control the air-conditioner smartly. What mentioned above is the mature controlling technology of the present air-conditioner.

Figure 1:
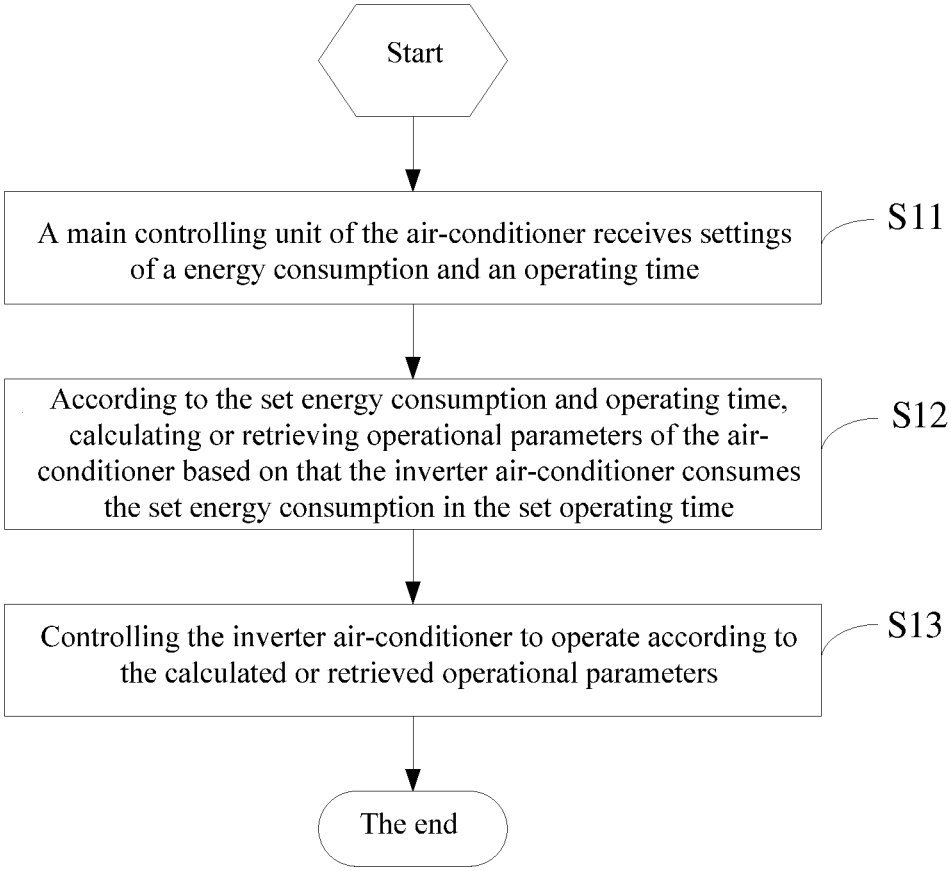
FIG. 1 is a flow chart of an energy saving controlling method of an inverter air-conditioner in accordance with an embodiment of the present disclosure.

Referring to FIG. 1, which is a flow chart of an energy saving controlling method of an inverter air-conditioner in accordance with an embodiment of the present disclosure. The method includes the following steps:

step S11, a main controlling unit of the air-conditioner receives settings of a energy consumption and an operating time;

step S12, according to the set energy consumption and operating time, calculating or retrieving operational parameters of the air-conditioner based on that the inverter air-conditioner consumes the set energy consumption in the set operating time; and step S13, controlling the inverter air-conditioner to operate according to the calculated or retrieved operational parameters.

In the above energy saving controlling method of the inverter air-conditioner, the settings of the energy consumption and the operating time can be realized by using a remote controller or a main controlling panel of the air-conditioner. Or, more than one group of parameters matching with each can be provided in the system of the air-conditioner which can be chosen by a button(s). After the energy consumption and the operating time set by the user are received, or after the energy consumption, the operating time, and a target indoor temperature are preset, the main controlling unit of the air-conditioner calculates or retrieves the operational parameters such as the operating power of the inverter air-conditioner correspondingly, so the inverter air-conditioner can operate according to the operational parameters. In this way, the energy consumption and the using cost of the inverter air-conditioner can be directly and accurately controlled by the user.

The operational parameters can contain different operational parameters depending on various operating situations of the inverter air-conditioner. For example, if the inverter air-conditioner works at a constant power, the operational parameters corresponding to the constant power can include the operating power, an operating frequency of the compressor under the operating power, revolutions of outdoor and indoor fans, etc. If the inverter air-conditioner works at a variable power, the operational parameters corresponding to the variable power can include power variation times, the operating frequency of the compressor in each phase, and the revolutions of the outdoor and indoor fans, etc.

Supposed that the energy consumption mentioned above is X and the operating time mentioned above is T, if the inverter air-conditioner works at a constant power, the constant power is X/T (dividing X by T); if the inverter air-conditioner works at a variable power, the set operating time T can be divided into time periods from T1 to Tn (T1, T2 Tn), correspondingly, the set energy consumption can be divided into sections from X1 to Xn (X1, X2 . . . Xn), wherein n is a natural number greater than or equal to 2 and X1/T1>Xn/Tn. T1, T2 . . . Tn or X1, X2 . . . Xn may not be equal to each other. After the corresponding operating power (for example, the constant power or the corresponding operating power in a corresponding time period) is calculated, the operating frequency of the compressor and/or the operating frequency of the fan can be controlled according to the calculated operating power.

The above energy consumption X and operating time T can be set according to actual situations, for example, the energy consumption X is preferably set within the range from 1 KW*h (kilowatt-hour) to 3 KW*h (kilowatt-hour) and the operating time T is preferably set within the range from 5 h (hours) to 10 h. The energy consumption X and the operating time T are required to match with giving the operating frequency of the inverter air-conditioner into consideration simultaneously. The settings of the energy consumption X and the operating time T are required to allow for the operation of the inverter air-conditioner so that inverter air-conditioner can meet requirements (such as requirements for refrigeration, heating, ventilating) of the user. For example, the energy consumption X of an IP air-conditioner of three-level energy efficiency is set to be 1 KW*h and the operating time T thereof is required to be longer than or equal to 2 hours. Thus, if the operating time is set to be 1 hour, the air-conditioner can only operate at the allowed maximum operating power; if the set energy consumption X is much less than the required consumption and the set operating time T is much longer than the required time, the target operating power will be much less than the operating power corresponding to the allowed minimum operating frequency of the air-conditioner, at this time, the minimum operating frequency of the air-conditioner is considered as the operational parameter. If the set energy consumption X does not match with the set operating time T, or the set energy consumption X and the set operating time T cannot meet the requirements of the user, the settings of the energy consumption X and the operating time T are not received. For example, if the energy consumed by the inverter air-conditioner working at the minimum operating power in the set operating time is still greater than the set energy consumption X, or if the user needs the air-conditioner to work in a refrigeration mode while the air-conditioner can only work in a ventilating mode according to the settings, the corresponding settings are not received. Additionally, if the settings include the setting of the target indoor temperature, the target indoor temperature is considered to be the restricting temperature, for example, if the target indoor temperature is set to be 26 degrees Celsius, the operating frequency of the compressor of the air-conditioner remains unchanged or is properly decreased when the air output from the air-conditioner reaches or is close to 26 degrees Celsius, which prevents the drop of the indoor temperature.

Figure 2:
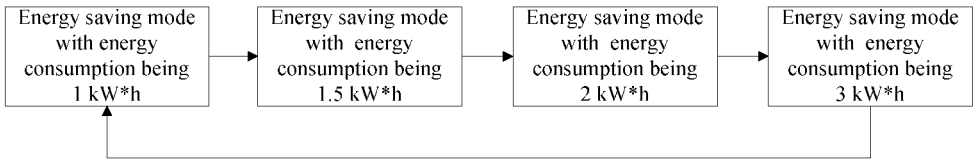
FIG. 2 is a schematic view showing multiple adjusting modes of an energy consumption in accordance with an embodiment of the present disclosure.

Options corresponding to the energy consumption, the operating time, and the target indoor temperature can be preset in the inverter air-conditioner of the above embodiment, thus, the user can choose the corresponding option to finish the settings conveniently. For example, the adjusting sate of an energy saving mode can be entered by pressing an "energy-saving" button formed on the remote controller or the main controlling panel of the air-conditioner: by displaying value of the energy consumption in the energy saving mode, the user can choose the needed energy saving mode by pressing the button. Specifically, as shown in FIG. 2, multiple energy saving modes are provided, and the energy saving modes can be switched by pressing the energy-saving button. If the air-conditioner is required to operate at a high power, the energy saving mode with the energy consumption being 3 KW*h and the operating time being 8 hours can be chosen; if the air-conditioner is required to operate at a low power, the energy saving mode with the energy consumption being 1 KW*h and the operating time being 8 hours can be chosen. The above energy consumption X and operating time T can be preset in the system or can be set by adding manual setting options on the controlling interface of the air-conditioner. The energy consumption of the embodiment can be respectively set to be 1 KW*h, 1.5 KW*h, 2 KW*h, and 3 KW*h, and the user can choose the needed mode via the remote controller or the main controlling panel of the air-conditioner. If the third energy saving mode, that is, the mode with the energy consumption being 2 KW*h is chosen by the user, the remote controller determines the chosen energy saving mode automatically; if the user cancels the energy saving mode, the remote controller immediately sends codes to cancel the energy saving mode. After the third energy saving mode is chosen, the operating time of the air-conditioner can be manually set to be 9 hours with the total energy consumption being 2 KW*h. At this time, if the inverter air-conditioner works at a constant power, the operating power W thereof is equivalent to 2 KW*h/9. If the target indoor temperature is set, the target indoor temperature defaults to 26 degrees Celsius when the inverter air-conditioner works in the refrigeration mode and defaults to about 20 degrees Celsius when the inverter air-conditioner works in a heating mode. When the inverter air-conditioner works in the refrigeration mode, the operating frequency of the air-conditioner is decreased if the indoor temperature is lower than the energy saving indoor temperature such as 26 degrees Celsius; when the inverter air-conditioner works in the heating mode, the operating frequency of the air-conditioner is decreased if the indoor temperature is higher than the energy saving temperature such as 20 degrees Celsius. It is noted that the user can set the target indoor temperature manually.

In an embodiment of the present disclosure, the energy saving mode can be entered through the energy-saving button, and the system thereafter works in the defaulted mode with the energy consumption being 1 KW*h and the operating time being 8 hours. At this situation, the operating power of the inverter air-conditioner is equivalent to KW*h/8, which is a constant power.

In an embodiment of the present disclosure, the energy saving mode can be entered through the energy-saving button, and the system thereafter works in the defaulted mode with the energy consumption being 1 KW*h and the operating time being 8 hours. At this situation, the operating power of the inverter air-conditioner is equivalent to 1 KW*h/8. The target energy consumption is 0.2 KW*h in a first phase lasting for 15 minutes and is 0.05 KW*h in a second phase lasting for 5 minutes, and the inverter air-conditioner operates at a constant power stably in the remaining 7 hours and 40 minutes using the left 0.75 KW*h of energy. The operating mode can improve the comfort of using the air-conditioner, that is, the compressor at first works at a high frequency in the earlier 20 minutes which can reduce the indoor temperature quickly in the refrigeration mode or increase the indoor temperature quickly in the heating mode, then the compressor works at a low frequency stably to keep the indoor temperature stable.

Figure 3:
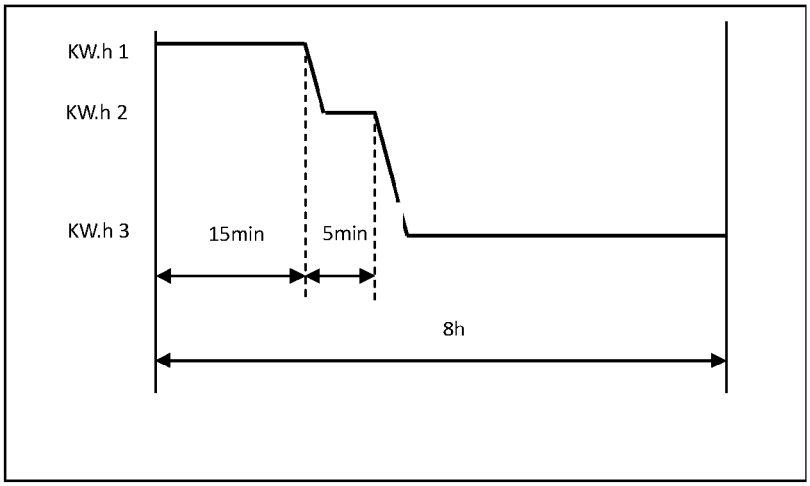
FIG. 3 is a schematic view showing how the energy consumption changes over time.

In an embodiment, the operating time defaults to 8 hours, the refrigeration energy saving temperature defaults to 26 degrees Celsius, and the inverter air-conditioner works in the refrigeration mode (referring to FIG. 3):

1. after the air-conditioner enters the energy saving mode, the compressor works at a controlled frequency, and entering the first phase of the energy saving mode;

condition 1: the compressor works at the frequency of 40 HZ for 15 minutes, and the indoor and outdoor fans work at moderate wind speeds; or condition 2: the actual indoor temperature t1 is lower than the set indoor temperature t2 (being preferably 26 degrees Celsius);

2. entering the second phase of the energy saving mode if any one of the above two conditions is met;

entering the third phase of the energy saving mode after the compressor works at a frequency of 30 HZ for 5 minutes in the second phase; or entering the third phase of the energy saving mode when t1 is lower than 26 degrees Celsius;

3. operating at a frequency of 10 HZ after entering the third phase of the energy saving mode; and 4. exiting the energy saving mode after 8 hours and operating in the automatic refrigeration mode or turning off the air-conditioner directly.

It is noted that the above quantified values are listed as examples. The parameters may be different depending on the energy efficiency of the air-conditioner. Generally, the total energy consumption can be kept close to the set energy consumption by experiments based on predetermined working conditions.

Figure 4:
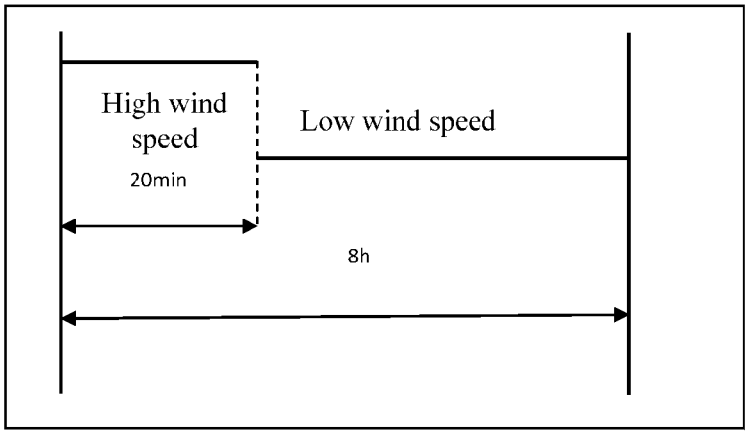
FIG. 4 is a schematic view showing how a fan changes over time.

Based on the above embodiment, the compressor and the indoor and outdoor fans can operate relative to each other, after the energy saving mode is started, the indoor fan operates at a high wind speed (for example, a speed-regulating fan works in the 80% shift) for 20 minutes and then operates at a low wind speed (for example, the speed-regulating fan works in the 30% shift), as shown in FIG. 4.

During the duration of the energy saving mode, the user is allowed to adjust the wind speed of the indoor fan through the remote controller, thus, the indoor fan can operate at the speed set by the user. Since the indoor fan does not affect the power of the whole air-conditioner much, thus, certain deviation of the total energy consumption of the air-conditioner is allowable.

The parameters of the above embodiment, such as the settings of the operating time and energy consumption, the setting of the fan, and the setting of the operating frequency of the compressor, etc, are listed as examples without having any limitation on the scope of the present disclosure.

Figure 5:
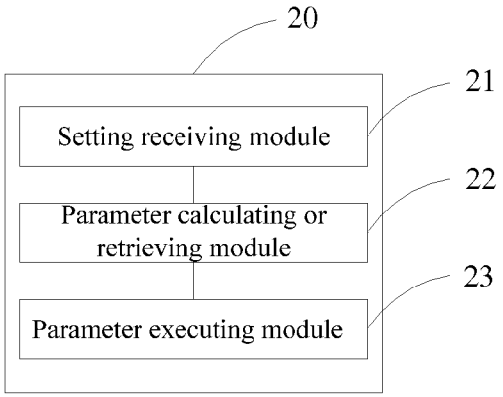
FIG. 5 is a schematic view of an energy saving device in accordance with an embodiment of the present disclosure.

Referring to FIG. 5, an energy saving controlling device 20 of an inverter air-conditioner in accordance with an embodiment of the present disclosure is provided. The energy saving controlling device 20 of the inverter air-conditioner includes: a setting receiving module 21, a parameter calculating or retrieving module 22, and a parameter executing module 23. The setting receiving module 21 is used for receiving the settings of an energy consumption and an operating time through a main controlling unit of the air-conditioner. The parameter calculating or retrieving module 22 is used for calculating or retrieving operational parameters of the air-conditioner based on that the air-conditioner consumes the set energy consumption in the set operating time according to the set energy consumption and the set operating time. The parameter executing module 23 is used for controlling the inverter air-conditioner to operate according to the calculated or retrieved operational parameters.

With the setting receiving module 21 receiving the set energy consumption and the set operating time from the user, or receiving preset energy consumption, operating time, and target indoor temperature, the parameter calculating or retrieving module 22 can calculate or retrieve the operational parameters such as a corresponding operating power of the inverter air-conditioner, thus, the parameter executing module 23 can control the inverter air-conditioner to operate according to the operational parameters. In this way, the user can control the energy consumption and the using cost of the inverter air-conditioner directly and accurately.

The operational parameters can contain different operational parameters depending on various operating situations of the inverter air-conditioner. For example, if the inverter air-conditioner works at a constant power, the operational parameters of the constant power can include the operating power, an operating frequency of the compressor under the operating power, revolutions of outdoor and indoor fans, etc. If the inverter air-conditioner works at a variable power, the operational parameters of the variable power can include power variation times, the operating frequency of the compressor in each phase, and the revolutions of the outdoor and indoor fans, etc.

Supposed that the energy consumption mentioned above is X and the operating time mentioned above is T, if the inverter air-conditioner works at a constant power, the constant power is X/T (dividing X by T); if the inverter air-conditioner works at a variable power, the set operating time T can be divided into time periods from T1 to Tn (T1, T2 Tn), correspondingly, the set energy consumption can be divided into sections from X1 to Xn (X1, X2 . . . Xn), wherein n is a natural number greater than or equal to 2 and X1/T1>Xn/Tn. T1, T2 . . . Tn or X1, X2 . . . Xn may not be equal to each other. After the corresponding operating power (for example, the constant power or the corresponding operating power in a corresponding time period) is calculated, the operating frequency of the compressor and/or the operating frequency of the fan can be controlled according to the calculated operating power.

The above energy consumption X and operating time T can be set according to actual situations, for example, the energy consumption X is preferably set within the range from 1 KW*h (kilowatt-hour) to 3 KW*h (kilowatt-hour) and the operating time T is preferably set within the range from 5 h (hours) to 10 h. The energy consumption X and the operating time T are required to match with giving the operating frequency of the inverter air-conditioner into consideration simultaneously. The settings of the energy consumption X and the operating time T are required to allow for the operation of the inverter air-conditioner so that inverter air-conditioner can meet requirements (such as requirements for refrigeration, heating, ventilating) of the user. For example, the energy consumption X of an IP air-conditioner of three-level energy efficiency is set to be 1 KW*h and the operating time T thereof is required to be longer than or equal to 2 hours. Thus, if the operating time is set to be 1 hour, the air-conditioner can only operate at the allowed maximum operating power; if the set energy consumption X is much less than the required consumption and the set operating time T is much longer than the required time, the target operating power will be much less than the operating power corresponding to the allowed minimum operating frequency of the air-conditioner, at this time, the minimum operating frequency of the air-conditioner is considered as the operational parameter. If the set energy consumption X does not match with the set operating time T, or the set energy consumption X and the set operating time T cannot meet the requirements of the user, the settings of the energy consumption X and the operating time T are not received. For example, if the energy consumed by the inverter air-conditioner working at the minimum operating power in the set operating time is still greater than the set energy consumption X, or if the user needs the air-conditioner to work in a refrigeration mode while the air-conditioner can only work in a ventilating mode according to the settings, the corresponding settings are not received. Additionally, if the settings further include the setting of the target temperature, whether the target temperature can be reached should be given into consideration when setting the energy consumption X and the operating time T. If the difference between the temperature which can be reached after the air-conditioner operates according to the set energy consumption and the set operating time and the target temperature is great, the settings are not received.

Even though information and the advantages of the present embodiments have been set forth in the foregoing description, together with details of the mechanisms and functions of the present embodiments, the disclosure is illustrative only; and that changes may be made in detail, especially in matters of shape, size, and arrangement of parts within the principles of the present embodiments to the full extend indicated by the broad general meaning of the terms in which the appended claims are expressed.

What is claimed is:

1. An energy saving controlling method of an inverter air-conditioner, comprising:

receiving settings of an energy consumption and an operating time by a main controlling unit of the inverter air-conditioner;

according to the set energy consumption and the set operating time, calculating or retrieving operational parameters of the inverter air-conditioner based on a ratio of the set energy consumption to the set operating time; and controlling the inverter air-conditioner to operate according to the calculated or retrieved operational parameters;

wherein the operational parameters of the inverter air-conditioner correspond to a variable power of the inverter air-conditioner, the energy consumption is X, the operating time is T, the set operating time T is divided into time periods from T1 to Tn, the set energy consumption X is correspondingly divided into sections from X1 to Xn, wherein n is a natural number greater than or equal to 2, the operating power of the inverter air-conditioner in each phase is obtained by dividing the energy consumption of the corresponding phase by the operating time of the corresponding phase, and X1/T1>Xn/Tn; the set energy consumption X is a target value of a total energy consumption in the set operating time T.

2. The energy saving controlling method of claim 1, wherein X ranges from 1 KW*h to 3 KW*h, and T ranges from 5 h to 10 h.

3. The energy saving controlling method of claim 2, wherein the settings further comprise the setting the target indoor temperature.

4. The energy saving controlling method of claim 3, wherein the energy consumption and the operating time, or the energy consumption and the operating time and the target indoor temperature are preset by system; or, options corresponding to the energy consumption and the operating time, or options corresponding to the energy consumption and the operating time and the target indoor temperature are preset to be chosen by a user.

5. The energy saving controlling method of claim 1, wherein T1, T2 . . . Tn or X1, X2 . . . Xn are not equal to each other.

6. The energy saving controlling method of claim 5, wherein T1, T2 . . . Tn and X1, X2 . . . Xn are not equal to each other.

7. The energy saving controlling method of claim 6, wherein the set energy consumption X is 1 KW*h and the set operating time T is 8 hours; a target energy consumption is 0.2 KW*h in a first phase of the set operating time lasting for 15 minutes and is 0.05 KW*h in a second phase of the set operating time lasting for 5 minutes, and the air-conditioner operates at a constant power stably in remaining 7 hours and 40 minutes of the set operating time using left 0.75 KW*h.

8. The energy saving controlling method of claim 6, wherein the operating time defaults to 8 hours; after the air-conditioner enters a energy saving mode, the air-conditioner works at a controlled frequency and enters a first phase of the energy saving mode;

after the air-conditioner works at a frequency of 40 HZ for 15 minutes, or when an actual indoor temperature t1 is lower than a set indoor temperature t2, the air-conditioner enters a second phase of the energy saving mode;

after the air-conditioner works at a frequency of 30 HZ for 5 minutes in the second phase, the air-conditioner enters a third phase of the energy saving mode;

the air-conditioner operates at a frequency of 10 HZ after entering the third phase of the energy saving mode; and the air-conditioner exits the energy saving mode after 8 hours and then operates in an automatic refrigeration mode or is directly turned off.

9. The energy saving controlling method of claim 8, wherein the air-conditioner comprises a compressor, an indoor fan and an outdoor fan; the compressor, the indoor fan and the outdoor fan operate relative to each other; and after the energy saving mode is started, the indoor fan operates at a high wind speed for 20 minutes and then operates at a low wind speed.

10. The energy saving controlling method of claim 9, wherein the indoor fan works in a 80% shift at the high wind speed; and the indoor fan works in a 30% shift at the low wind speed.

* * * * *